US008661824B2

(12) United States Patent
Pelletier et al.

(10) Patent No.: US 8,661,824 B2
(45) Date of Patent: Mar. 4, 2014

(54) AIRBLAST FUEL NOZZLE ASSEMBLY

(75) Inventors: Robert R. Pelletier, Chardon, OH (US); Michael K. Teter, Madison, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 904 days.

(21) Appl. No.: 12/787,470

(22) Filed: May 26, 2010

(65) Prior Publication Data

US 2010/0300105 A1 Dec. 2, 2010

Related U.S. Application Data

(60) Provisional application No. 61/180,974, filed on May 26, 2009.

(51) Int. Cl.
*F02C 1/00* (2006.01)
*F02G 3/00* (2006.01)

(52) U.S. Cl.
USPC ..... 60/742; 60/740; 60/743; 60/746; 60/748

(58) Field of Classification Search
USPC ..... 60/739–748
See application file for complete search history.

(56) References Cited

U.S. PATENT DOCUMENTS

| | | | | |
|---|---|---|---|---|
| 5,277,023 | A * | 1/1994 | Bradley et al. | 60/39.094 |
| 5,505,045 | A * | 4/1996 | Lee et al. | 60/748 |
| 6,345,505 | B1 * | 2/2002 | Green | 60/748 |
| 6,363,726 | B1 * | 4/2002 | Durbin et al. | 60/748 |
| 2002/0134084 | A1 * | 9/2002 | Mansour et al. | 60/740 |
| 2006/0248898 | A1 * | 11/2006 | Buelow et al. | 60/776 |
| 2009/0277176 | A1 | 11/2009 | Caples | |

* cited by examiner

*Primary Examiner* — Gerald L Sung
*Assistant Examiner* — Craig Kim
(74) *Attorney, Agent, or Firm* — Renner, Otto, Boisselle & Sklar, LLP

(57) ABSTRACT

An airblast fuel nozzle assembly (10) comprising a sleeve structure having a series of coaxial sleeves forming an inner-air circuit, an outer-air circuit, a main-fuel-feed circuit, and a pilot-fuel-feed circuit. The pilot-fuel-feed circuit includes a channel (44), and a discharge region (45) with exits (46). The exits (46) have a combined cross-sectional area that is substantially less than the cross-sectional area of the channel (44) upstream of the discharge region (45). In this manner, the pilot-fuel-feed circuit itself can provide a relatively large pressure drop across the channel region (44), and thereby assist in self atomization during ignition stages of engine operation.

20 Claims, 12 Drawing Sheets

AIRBLAST FUEL NOZZLE ASSEMBLY

RELATED APPLICATION

This application claims priority of U.S. Provisional Application No. 61/180,974 filed on May 26, 2009. The entire disclosure of this provisional application is hereby incorporated by reference. If incorporated-by-reference subject matter is inconsistent with subject matter expressly set forth in the written specification (and/or drawings) of the present application, the latter governs to the extent necessary to eliminate indefiniteness and/or clarity-lacking issues.

BACKGROUND

A gas turbine engine typically includes one or more fuel injectors. A fuel injector can comprise an airblast fuel nozzle assembly adapted to suitably mix fuel and air, and positioned to direct this air-fuel mixture into the engine's combustion chamber. Such a nozzle assembly is typically assumed to provide low-emission fuel injection, as inner and outer air circuits are used to atomize the fuel to facilitate consistent and uniform mixing.

SUMMARY

A fuel airblast nozzle assembly is provided that can function, for example, as a fuel injector in a gas turbine engine. The nozzle assembly can comprise both a main-fuel-feed circuit and a pilot-fuel-feed circuit, with the pilot-fuel-feed circuit providing a relatively large pressure drop across a channel discharge region. With such a circuit construction, a significant drop in air pressure (across the nozzle) is not necessary during ignition stages of engine operation, because the pilot-fuel pressure drop itself can adequately assist in atomization. And during post-ignition engine operation (when large drops in air pressure will exist), the main-fuel-feed circuit can be additionally or alternatively activated to take advantage of the low-emission mixing characteristics common in airblast-nozzle designs.

DRAWINGS

DESCRIPTION

Figure 1:
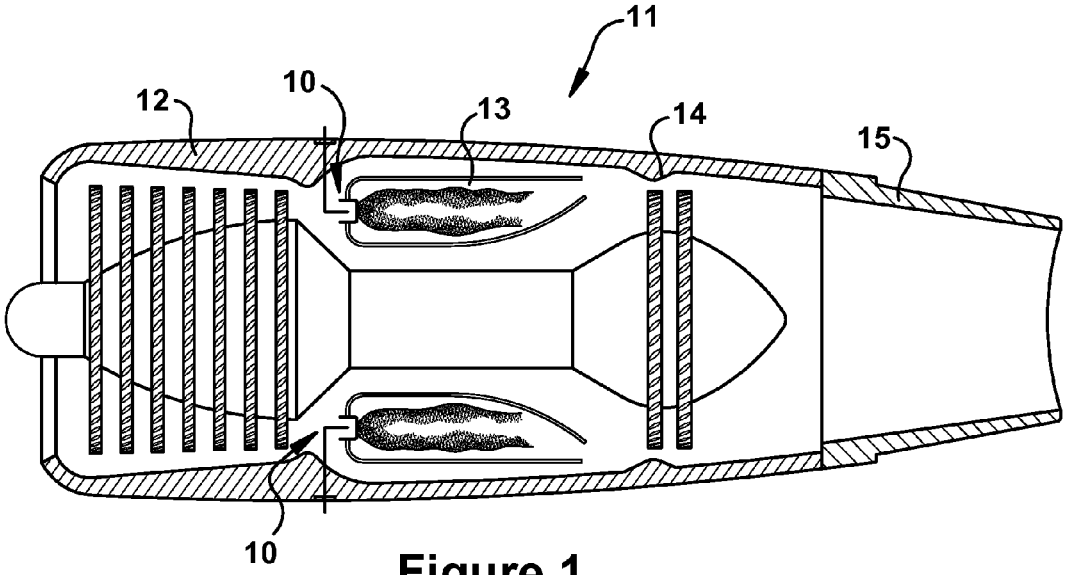
FIG. 1 is a schematic illustration showing airblast fuel nozzle assemblies installed in a gas turbine engine for fuel injection.
Figure 2:
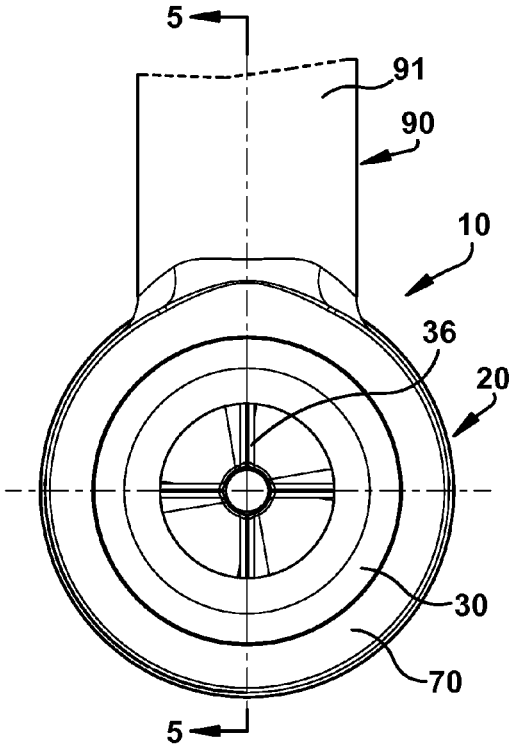
FIGS. 2-4 are upstream, downstream, and side views of the nozzle assembly.
Figure 3:
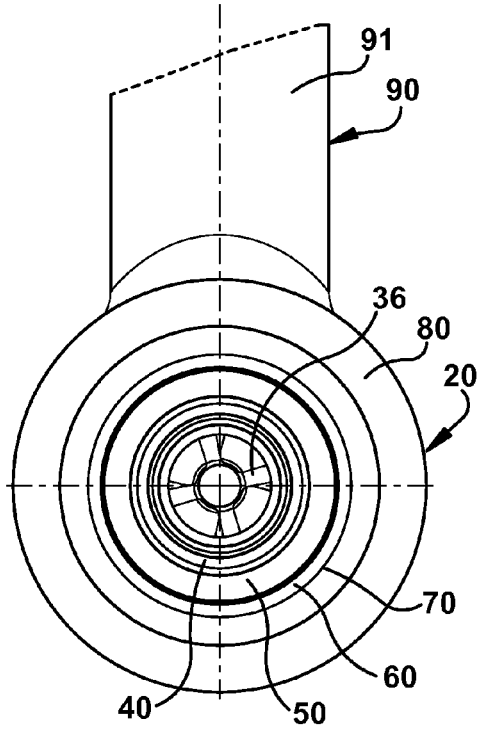
Figure 4:
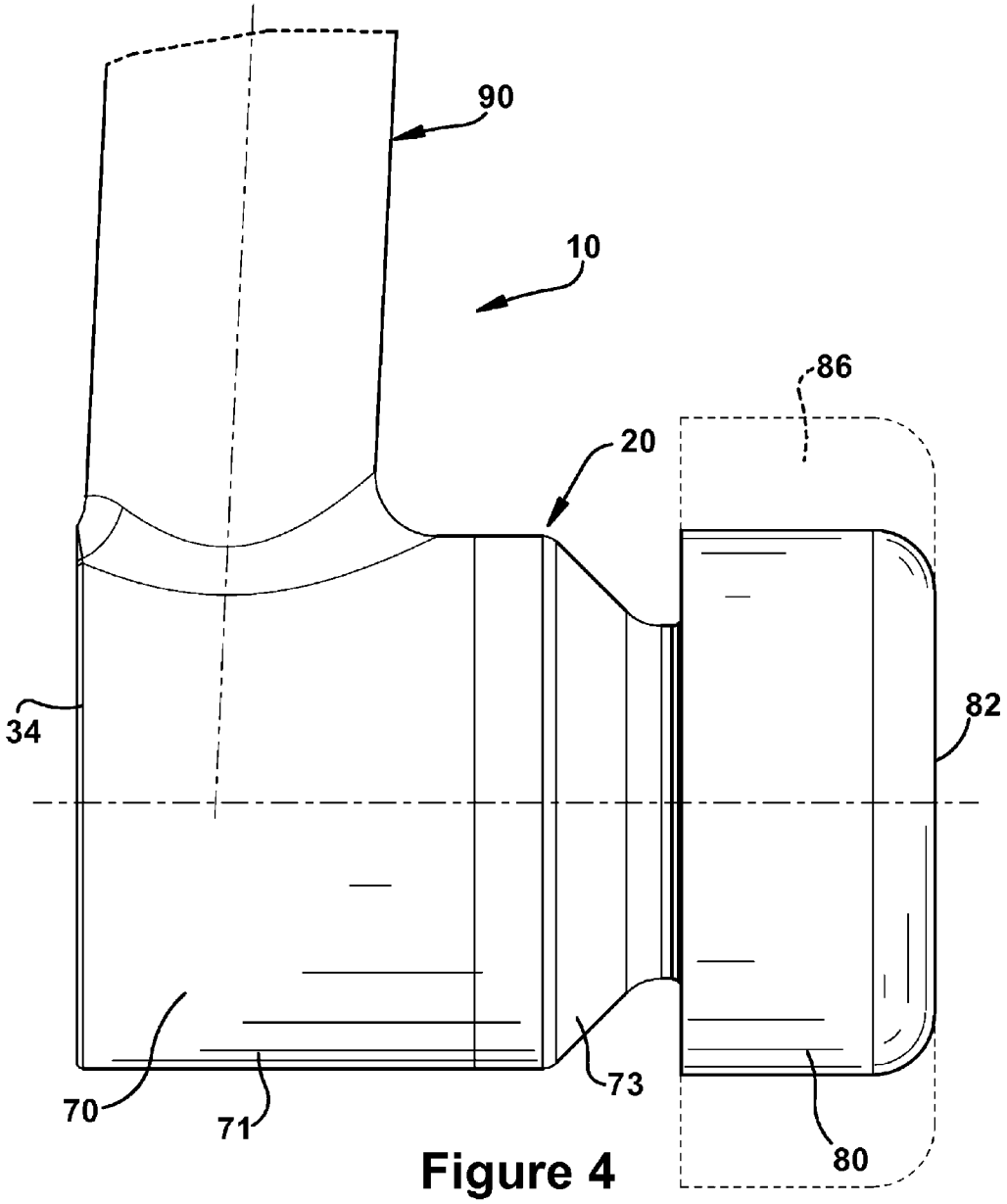
Figure 5:
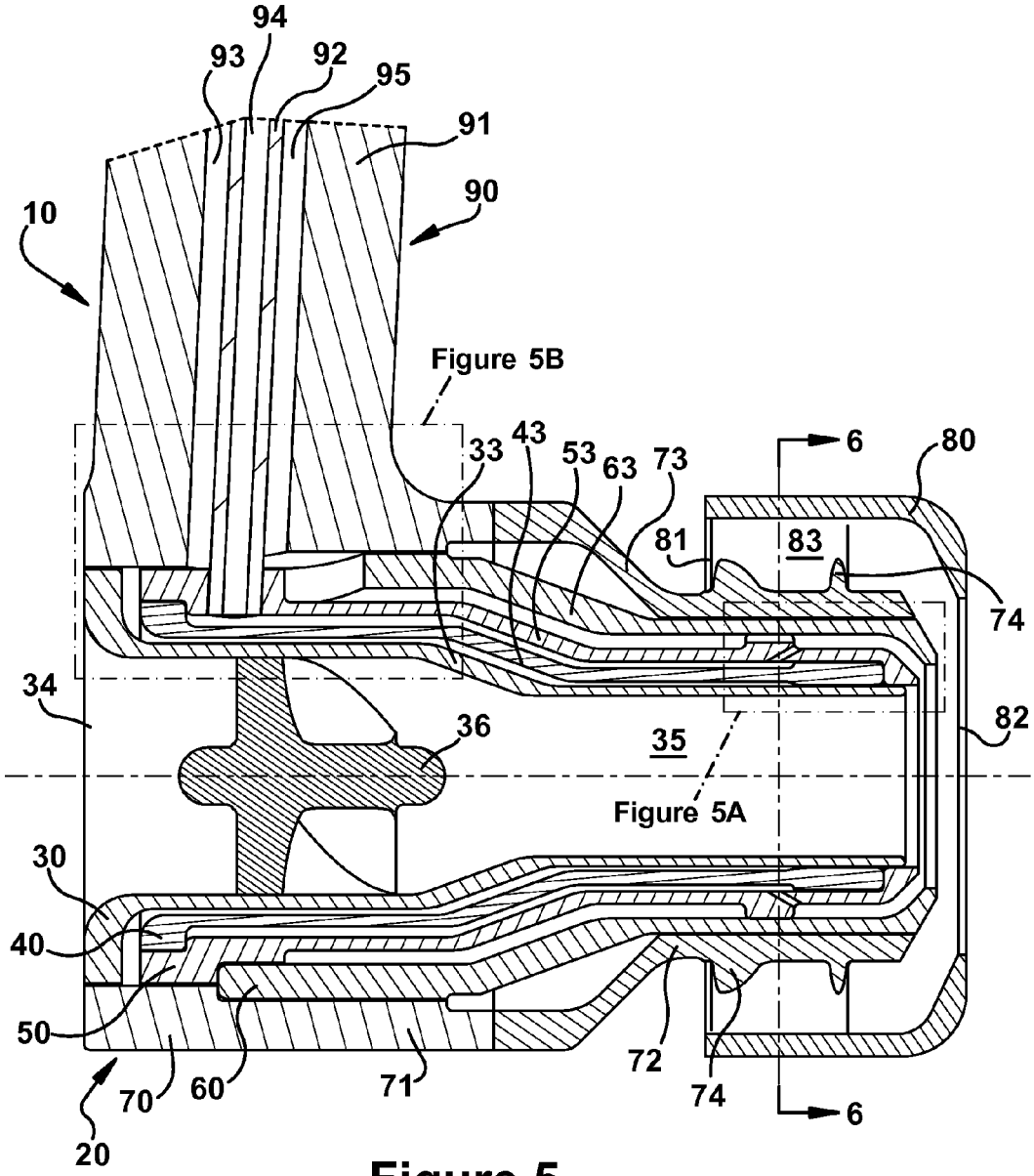
FIG. 5 is a sectional view of the nozzle assembly, as seen along line 5-5 in FIG. 2, and FIGS. 5A-5B are close-up views of designated regions of FIG. 5.
Figure 5A:
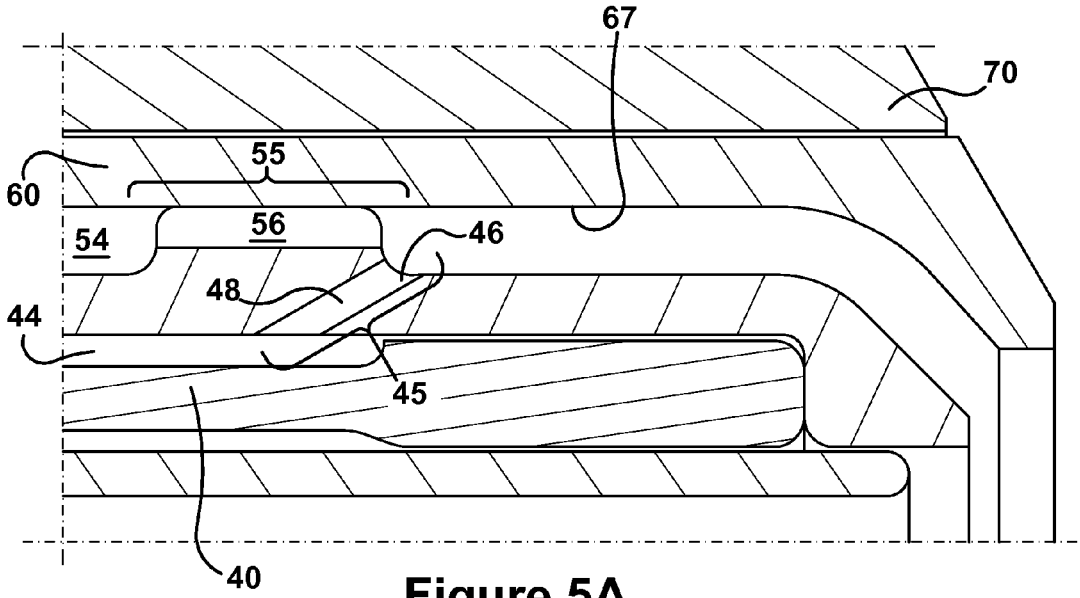
Figure 5B:
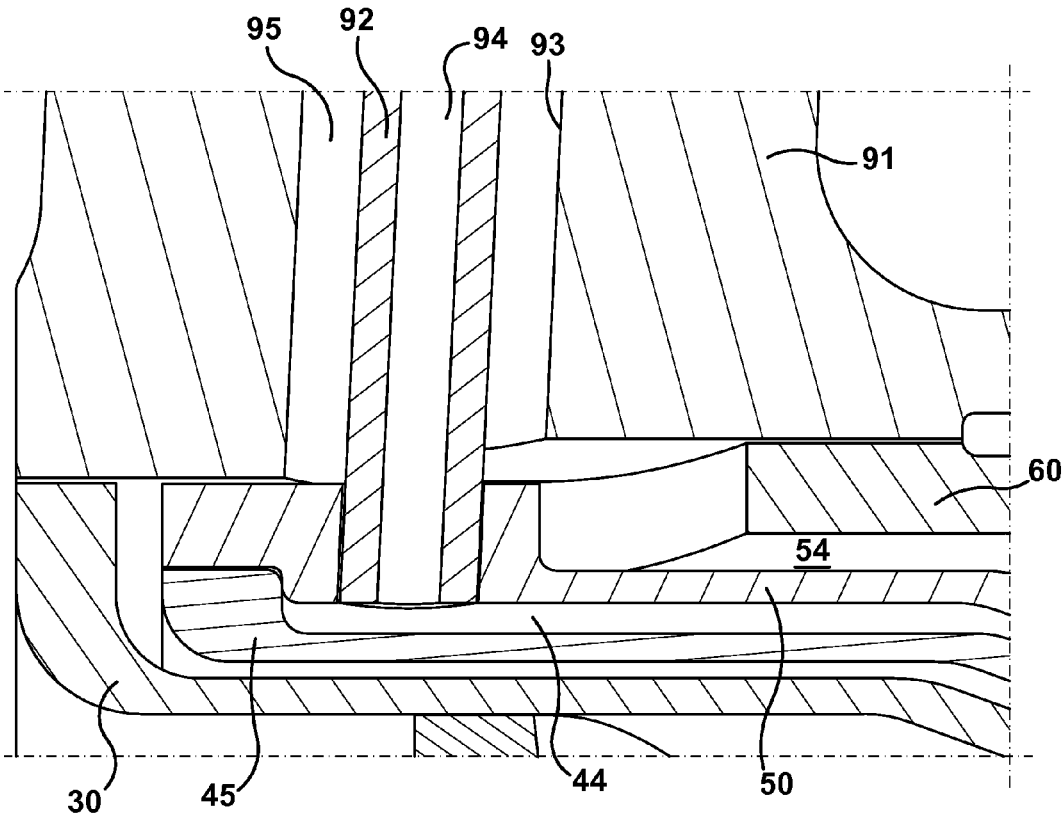
Figure 6:
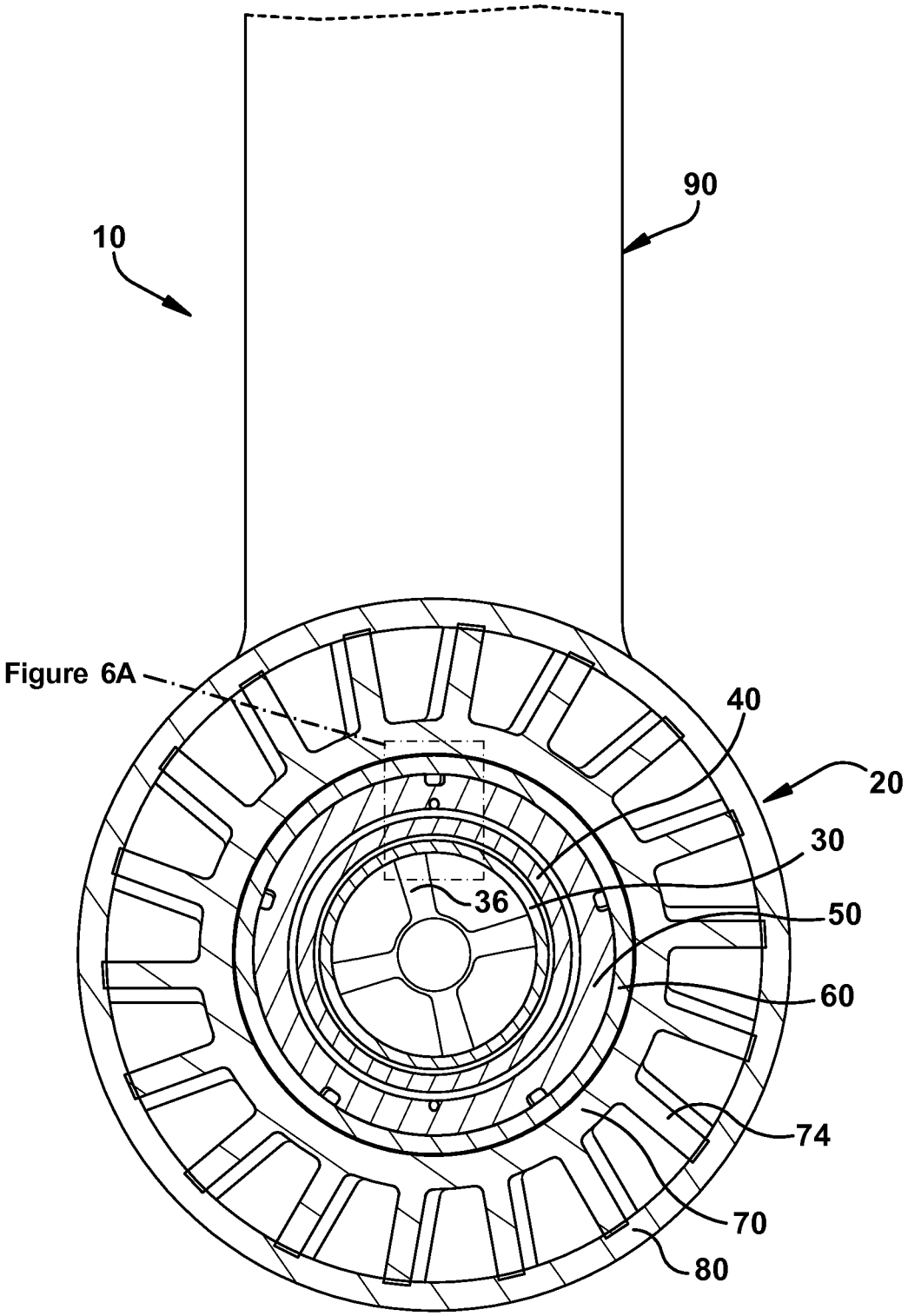
FIG. 6 is a sectional view of the nozzle assembly, as seen along line 6-6 in FIG. 5
Figure 6A:
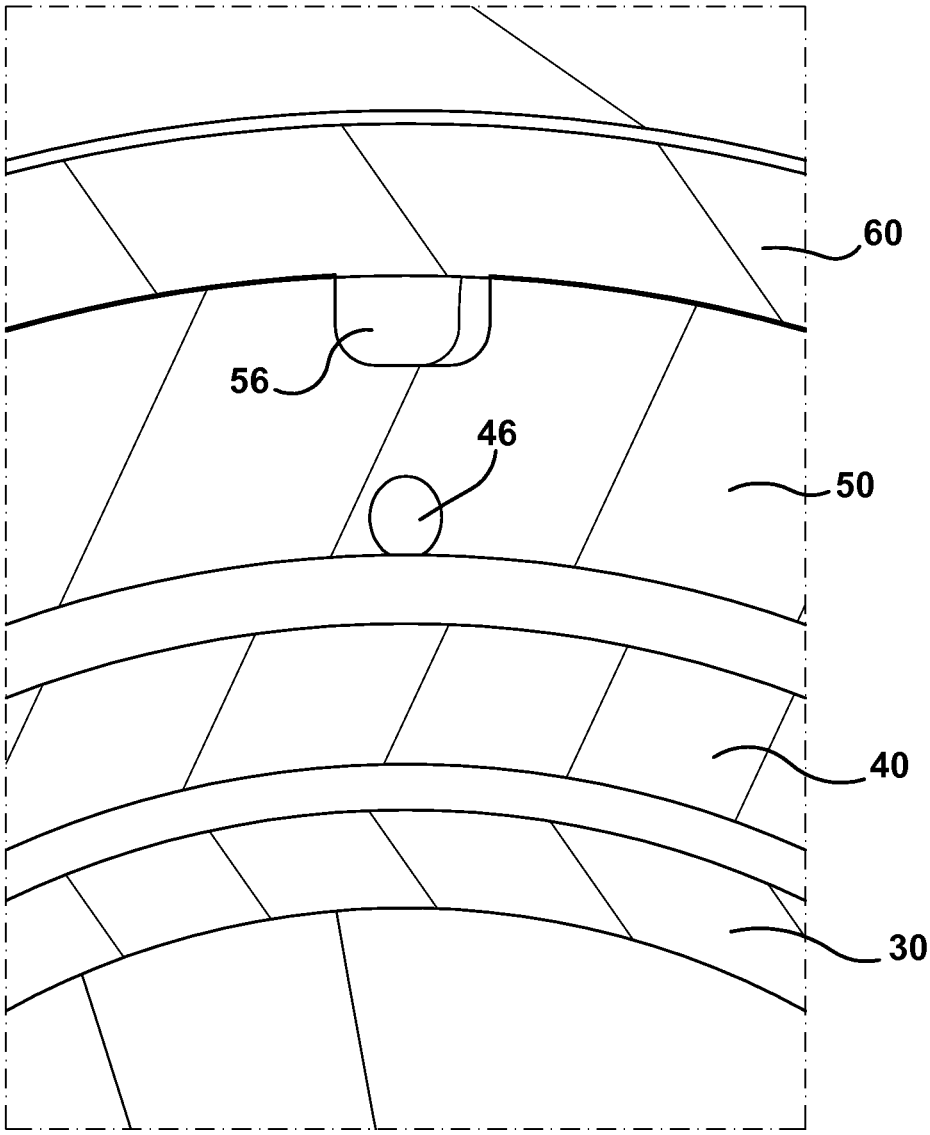
FIG. 6A is a close-up view of the designated region of FIG. 6.

An airblast fuel nozzle assembly 10 is shown installed in a gas turbine engine 11 in FIG. 1. The illustrated engine 11 generally comprises a compressor section 12, a combustion chamber 13, a turbine section 14, and an exhaust section 15. The nozzle assembly 10 can be mounted just downstream of the compressor section 12 to inject a fuel-air mixture into radial outer regions of the combustion chamber 13. The gas turbine engine 11 can be, for example, an engine of an aircraft.

The airblast fuel nozzle assembly 10, shown in FIGS. 2-6, can comprise an axial sleeve structure 20. The sleeve structure 20 comprises a series of coaxial sleeves 30-80, with sleeves 30-70 each including an intermediate necked portion 33-73, respectively, that tapers inwardly in the downstream direction. (Non-necked sleeves are also possible and contemplated.) The sleeve 40 surrounds the sleeve 30, the sleeve 50 surrounds the sleeve 40, the sleeve 60 surrounds the sleeve 50, and the sleeve 70 surrounds the sleeve 60.

The innermost sleeve 30 has an inlet 34 opening into a central passageway 35 that extends therethrough. In the illustrated embodiment, a vaned swirler 36 is situated within the central passageway 35, upstream of the necked portion 33. The swirler 36 shown has a plurality of angled vanes and is fixedly mounted (i.e., it does rotate relative to the sleeve 30) within the passageway 35. Other swirler constructions, vane designs, and/or a sleeve 30 without a swirler 36 are possible and contemplated.

A fuel-feed channel 44 is situated between the sleeve 40 and the sleeve 50, and another fuel-feed channel 54 is situated between the sleeve 50 and the sleeve 60. The channel 44 travels along the axial length of the sleeves 40/50 until it reaches a discharge region 45 including channel exits 46. The channel 54 travels along the axial length of the sleeves 50/60 until it reaches a discharge region 55 including channel exits 56. A prefilming surface 67 is located downstream of the channel exits 46 and the channel exits 56.

The fuel-feed channel 44 can be continuous (e.g., cylindrical) or separated into distinct streams via webs, slots, or other features in the sleeves between which it is situated. The discharge region 45 is formed by a portion of the sleeve 50 and the exits 46 are the open downstream ends of passages 48 (e.g., slots, holes, apertures, etc.) that extend through this region. The passages 48 extend radially outward to thereby convey the pilot fuel directly against the prefilming surface 67 (which is a cylindrical surface formed by the inner surface of the sleeve 60). This radially-outward geometry of the exit(s) may be advantageous in nozzle designs that incorporate only one fuel-feed circuit.

The fuel-feed channel 54, like the fuel-feed channel 44, can be continuous (or not). The discharge region 54 can occupy a radial flange around the sleeve 50 and the exits 56 (e.g., slots, holes, apertures, etc.) can be open downstream ends of passages 58 that extend through this radial flange 55. These passages 58 can be angled (or not) relative to the sleeve's axial direction to provide (or not provide) a swirled exit path.

The discharge region 45 and the discharge region 55 will usually be located downstream of the necked portions 43/53 of the sleeves 40/50. In the embodiment shown in FIGS. 2-5, the exits 46 are located slightly downstream of the exits 56. Other exit locations (e.g., inversed or aligned) are possible and contemplated.

The sleeve 70 can comprise an upstream section 71 and a downstream section 72, with the latter section 72 including the necked portion 73. The upstream end of the sleeve 80 forms an annular inlet 81 around the sleeve 70 and its downstream end forms a nozzle outlet 82. The sleeve 70 and the sleeve 80 define an annular passageway 83 therebetween.

Swirling vanes 74, situated within the passageway 83, can extend radially outward from sleeve 70 and/or radially inward from the sleeve 80.

The sleeve structure 20 forms an inner-air circuit, an outer-air circuit, a pilot-fuel-feed circuit, and a main-fuel-feed circuit. The inner-air circuit comprises the central passageway 35 and extends from the inlet 34 to the nozzle outlet 82. The outer-air circuit comprises the annular passageway 83 and extends from the inlet 81 to the nozzle outlet 82. As shown in dashed lines in FIG. 4, the nozzle assembly 10 can additionally include a sleeve 86 or other structure forming a further domed-air circuit surrounding the outer-air circuit. This further air circuit may be desirable, for example, to shape the fuel-air mixture leaving the nozzle outlet 82 and/or to supplement the mixture with additional air.

The pilot-fuel-feed circuit comprises the channel 44, the exits 46, and the prefilming surface 67. The pilot-fuel-feed-circuit exits 46 have a combined cross-sectional area that is substantially less than that of the channel 44 upstream of the discharge region 45. This exit geometry causes the pilot fuel to experience a pressure drop (e.g., at least 3 psi, at least 5 psi, and/or at least 10 psi) across the discharge region 45 that is sufficient for self atomization. For example, the cross-sectional area of the channel 44 can be at least twice as great, at least three times as great, and/or at least four times as great as the combined cross-sectional area of the exits 46.

The main-fuel-feed circuit comprises the channel 54, the exits 56, and the prefilming surface 67. The main-fuel-feed-circuit exits 56 can have a combined cross-sectional area that is less than that of the channel 54 upstream of the discharge region 55. The combined cross-sectional area of the exits 56 can be greater (e.g., 20% greater, 30% greater, 40% greater) than that of the pilot-fuel-feed-circuit exits 46. That being said, exits 56 of the same or smaller size than the exits 46 (either individually or collectively) is possible and contemplated.

The feed circuits can instead be reversed, with the radially outer channel 44 being part of the main-fuel-feed circuit and the radially inner channel 54 being part of the pilot-fuel-feed circuit.

The airblast fuel nozzle assembly 10 can further comprise a radial sleeve structure 90 with an outer sleeve 91 and an inner sleeve 92. In the illustrated embodiment, the outer sleeve 91 is formed in one piece with the upstream section 71 of the sleeve 70. The outer sleeve 92 includes an opening 93 therethrough and the inner sleeve 92 is positioned within this opening 93. A channel 94 is formed within the inner sleeve 92 and another channel 95 is formed therearound. The channel 94 is in fluid communication with the channels 44 in the sleeve structure 20 and thus serves as an introduction channel to the pilot-fuel-feed circuit. The channel 95 is in fluid communication with the channel 54 in the sleeve structure 20, and thus serves as an introduction channel to the main-fuel-feed circuit.

In the engine 11, air is drawn through the inner-air circuit and the outer-air circuit from the engine's compressor section 12. The introduction channels 94 and 95 can each be connected to a fuel tank (not shown) to thereby supply fuel to the pilot-fuel-feed-circuit channels 44 and 54, respectively. Controls (e.g., valves, switches, etc.) can be appropriately provided so as to allow pilot fuel and main fuel to be selectively introduced to their respective circuits.

During the ignition stage of engine operation, fuel can be supplied (e.g., through the introduction channel 94) substantially only to the pilot-fuel-feed circuit. (There may sometimes be a slight drip or drool through the main-fuel-feed-circuit.) The supplied fuel will flow through the channel 44, discharge through exits 46, and impinge against the prefilming surface 47. The pilot fuel will then join the inner-air circuit, later merge with the outer-air circuit, and leave the nozzle assembly 10 in a fuel-air mixture through outlet 82. Because the pressure drop across the discharge region 45 is sufficient to facilitate atomization, a large drop in air pressure is not necessary during ignition stages of engine operation.

During post-ignition engine operation (when large drops in air pressure are present), fuel can also be supplied to both fuel-feed circuits (e.g., through both introduction channels 94-95) or fuel can be supplied to only the main-fuel-feed circuit (e.g., through only the introduction channel 95). In either or any event, the main fuel will flow downstream through channels 54, discharge through exits 56, and impinge against the prefilming surface 67. The main-fuel-feed circuit can be designed to provide optimum fuel-air mixing (and thus low emissions) without having to compromise for ignition conditions. And aside from ignition issues, the fuel-feed circuits can be staged to optimize combustion characteristics.

Figure 7:
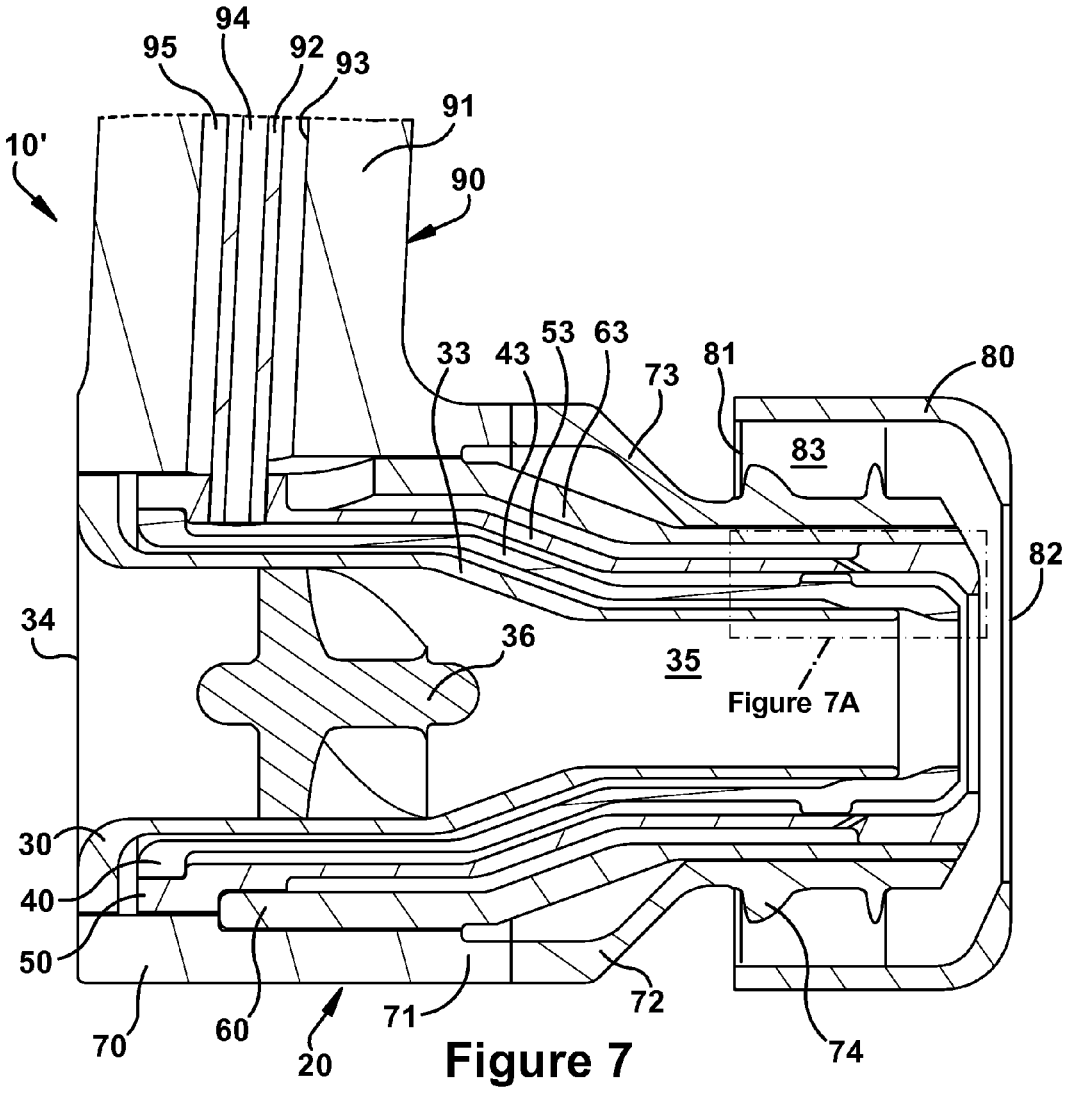
FIG. 7 is a sectional view (similar to that of FIG. 5) of a modified version of the nozzle assembly.
Figure 7A:
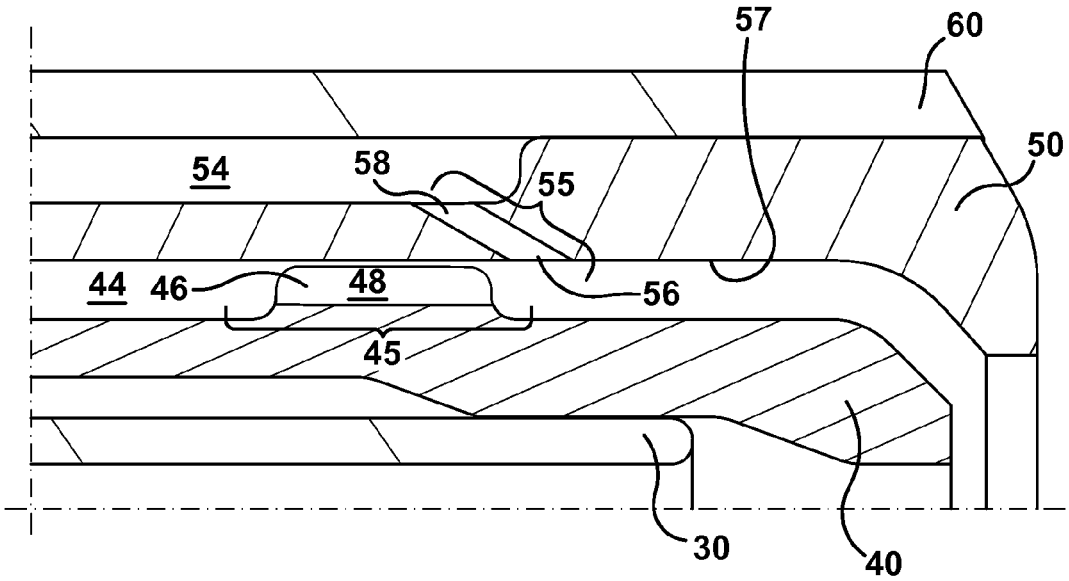
FIG. 7A is a close-up view of the designated region of FIG. 7.

In the airblast fuel nozzle assembly 10' shown in FIG. 7, the radially outer channel 44 is the main-fuel-feed-circuit channel and the radially inner channel 54 is the pilot-fuel-feed-circuit channel. (The roles of the introduction channels 94-95 would likewise be reversed.) As is best seen by referring additionally to FIG. 7A, the fuel circuits share a common prefilming surface 57 formed on an inner surface of the sleeve 50. The sleeve 40 includes a radial flange forming the discharge region 45 of the main-fuel-feed circuit. The discharge region 55 of pilot-fuel-feed circuit occupies a region of the sleeve 50 downstream of its necked portion 53. The pilot-fuel-feed-circuit exits 56 are the downstream ends of passageways 58 extending through the discharge region 55. The passageways 58 are angled inward and the exits 56 face the outer surface of the sleeve 40. The passageways 58 can incorporate swirling geometry so that pilot fuel exiting the passageways 58 will be conveyed towards the prefilming surface 56. Otherwise, the operation and flow patterns of the nozzle assembly 10' are essentially the same as the nozzle assembly 10.

Figure 8:
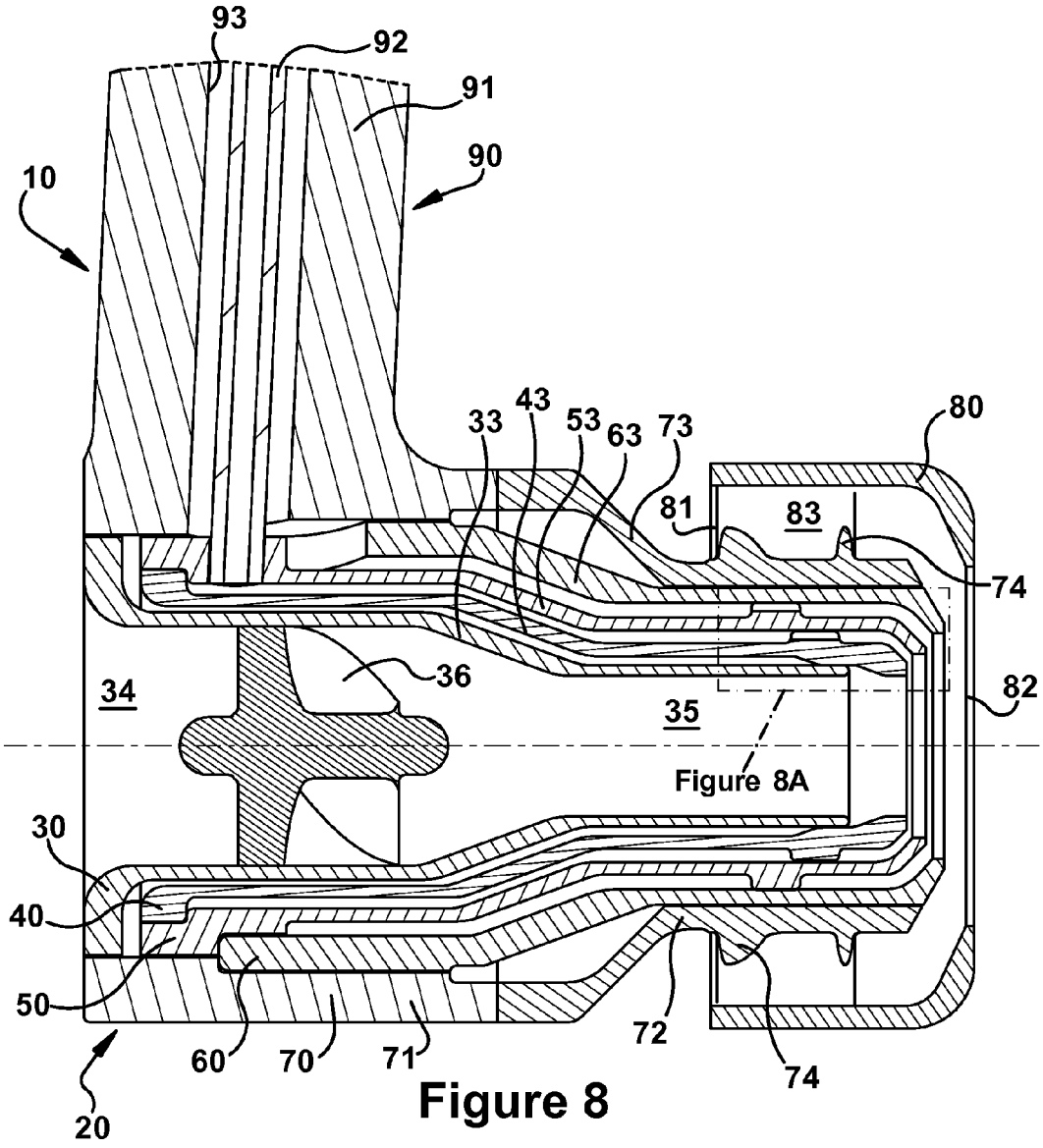
FIG. 8 is a sectional view (similar to that of FIG. 5 and FIG. 7) of a modified version of the nozzle assembly.
Figure 8A:
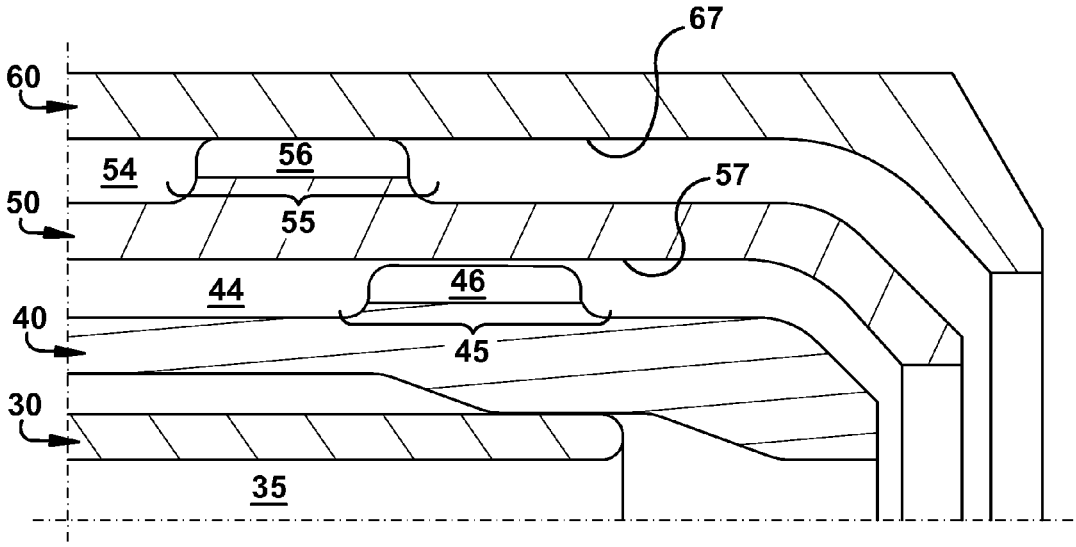
FIG. 8A is a close-up view of the designated region of FIG. 8.

In the airblast fuel nozzle assembly 10" shown in FIG. 8, the channel 44 could be pilot-fuel-feed-circuit channel and the channel 54 could be the main-fuel-feed-circuit channel, or vice a versa. As is best seen by referring additionally to FIG. 8A, this assembly 10" includes a prefilming surface 57 (on the inner surface of sleeve 50) for one of the fuel-feed circuits and a separate prefilming surface 67 (on the inner surface of sleeve 60) for the other fuel-feed circuit. The discharge region 44 is formed by a radial flange around the sleeve 40 and the discharge region 54 is formed by another radial flange around the sleeve 50. And the channels exits 46 and the channel exits 56 are the open downstream ends of passages 48/58 (e.g., slots, holes, apertures, etc.) that extend through the respective radial flange 45/55.

Figure 9:
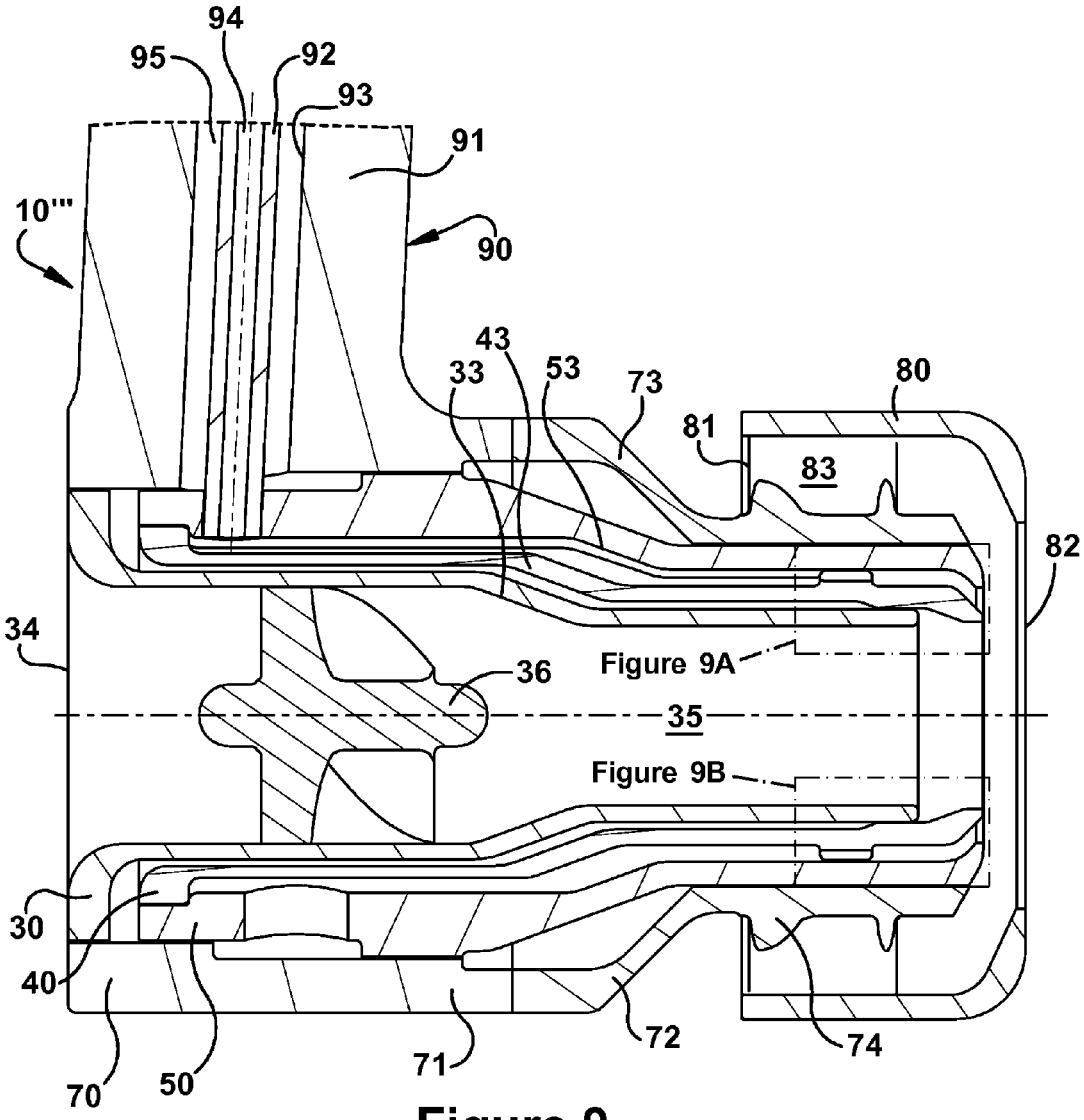
FIG. 9 is a sectional view (similar to that of FIG. 5, FIG. 7 and FIG. 8) of a modified version of the nozzle assembly.
Figure 9A:
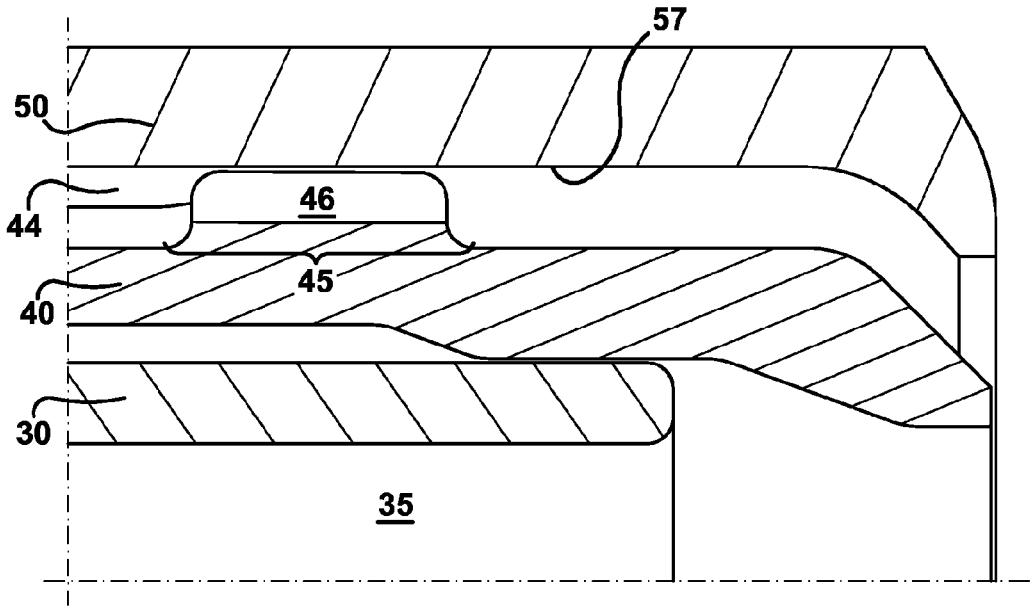
FIGS. 9A-9B are each a close-up view of the designated regions of FIG. 9.
Figure 9B:
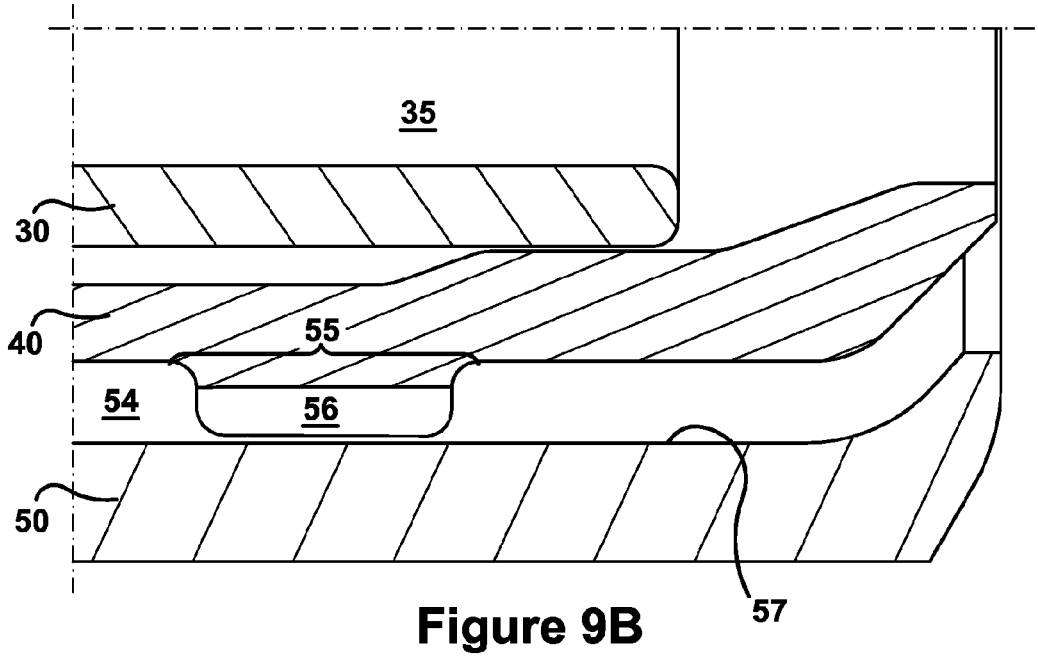

In the airblast fuel nozzle assembly 10''' shown in FIG. 9, the sleeve 60 is merged into the sleeve 70 whereby sleeve 70 surrounds sleeve 50. And instead of one channel 54 being positioned radially outward from the other channel 44, both channels 44 and 54 are radially situated in the same annual space between the sleeves 40 and 50. Webs or other dividers can be provided to separate the two fuel-feed circuits within this annular space. As is best seen by referring additionally to FIGS. 9A-9B, both discharge regions 44 and 54 (and thus exits 46 and 56) are formed by radially flanges around the sleeve 40. The channel 44 could be pilot-fuel-feed-circuit channel and the channel 54 could be the main-fuel-feed-circuit channel, or vice a versa. In either event, the fuel-feed circuits can share a prefilming surface 57 formed (on the inner surface of the sleeve 50).

Although the airblast fuel nozzle assembly 10/10'/10"/10''', the engine 11, and/or the sleeve structure 20 has been shown and described with respect to a certain embodiments, equivalent alterations and modifications should occur to others skilled in the art upon review of this specification and drawings. If an element (e.g., component, assembly, system, device, composition, method, process, step, means, etc.), has been described as performing a particular function or functions, this element corresponds to any functional equivalent (i.e., any element performing the same or equivalent function) thereof, regardless of whether it is structurally equivalent thereto. And while a particular feature may have been described with respect to less than all of embodiments, such feature can be combined with one or more other features of the other embodiments.

The invention claimed is:

1. An airblast fuel nozzle assembly comprising a sleeve structure forming an inner-air circuit, an outer-air circuit, a main-fuel-feed circuit, and a pilot-fuel-feed circuit;

the inner-air circuit including a central passageway through the sleeve structure extending to a nozzle outlet;

the outer-air circuit including an annular passageway radially surrounding the central passageway and extending to the nozzle outlet;

the pilot-fuel-feed circuit comprising a channel surrounding the inner-air-circuit central passageway, a prefilming surface surrounding the inner-air-circuit central passageway, and a discharge region with exits configured to convey pilot-feed fuel from the channel against the prefilming surface;

the main-fuel-feed circuit, the pilot-fuel-feed circuit, the inner-air circuit and the outer-air circuit being arranged such that flows through the main-fuel-feed circuit and the pilot-fuel-feed circuit merge with flows through the inner-air circuit and the outer-air circuit downstream of the prefilming surface;

the pilot-fuel-feed-circuit exits having a combined cross-sectional area that is substantially less than the cross-sectional area of the channel upstream of the discharge region; and the pilot-fuel-feed-circuit and the main-fuel-feed-circuit downstream of the discharge region are separated by and immediately adjacent a sleeve.

2. An airblast fuel nozzle assembly as set forth in claim 1, wherein the channel and/or the exits of the pilot-fuel-feed circuit are sized to cause the pilot fuel to experience a pressure drop of at least 3 psi across the discharge region.

3. An airblast fuel nozzle assembly as set forth in claim 1, wherein the channel and/or the exits of the pilot-fuel-feed circuit are sized to cause the pilot fuel to experience a pressure drop of at least 5 psi across the discharge region.

4. An airblast fuel nozzle assembly as set forth in claim 1, wherein the channel and/or the exits of the pilot-fuel-feed circuit are sized to cause the pilot fuel to experience a pressure drop of at least 10 psi across the discharge region.

5. An airblast fuel nozzle assembly comprising a sleeve structure forming an inner-air circuit, an outer-air circuit, a main-fuel-feed circuit, and a pilot-fuel-feed circuit;

the inner-air circuit including a central passageway through the sleeve structure extending to a nozzle outlet;

the outer-air circuit including an annular passageway radially surrounding the central passageway and extending to the nozzle outlet;

the pilot-fuel-feed circuit comprising a channel surrounding the inner-air-circuit central passageway, a prefilming surface surrounding the inner-air-circuit central passageway, and a discharge region with exits configured to convey pilot-feed fuel from the channel against the prefilming surface;

the main-fuel-feed circuit, the pilot-fuel-feed circuit, the inner-air circuit and the outer-air circuit being arranged such that flows through the main-fuel-feed circuit and the pilot-fuel-feed circuit merge with flows through the inner-air circuit and the outer-air circuit downstream of the prefilming surface;

the pilot-fuel-feed-circuit exits having a combined cross-sectional area that is substantial less than the cross-sectional area of the channel upstream of the discharge region;

wherein the main-fuel-feed circuit comprises a channel surrounding the inner-air circuit, and a discharge region having exits configured to convey the main-feed fuel to the same prefilming surface as the pilot-fuel-feed-circuit exits.

6. An airblast fuel nozzle assembly as set forth in claim 5, wherein the main-fuel-feed-circuit channel is situated radially outward from the pilot-fuel-feed-circuit channel.

7. An airblast fuel nozzle assembly as set forth in claim 5, wherein the main-fuel-feed-circuit channel is situated radially inward from the pilot-fuel-feed-circuit channel.

8. An airblast fuel nozzle assembly as set forth in claim 5, wherein the main-fuel-feed-circuit channel is situated radially in the same annular space as the pilot-fuel-feed-circuit channel.

9. An airblast fuel nozzle assembly as set forth in claim 5, wherein the main-fuel-feed circuit, the pilot-fuel-feed circuit, the inner-air circuit and the outer-air circuit are arranged such that flows through the main-fuel-feed circuit and the pilot-fuel-feed circuit merge with flows through the inner-air circuit and the outer-air circuit upstream of the nozzle outlet.

10. An airblast fuel nozzle assembly as set forth in claim 1, wherein the main-fuel-feed circuit comprises a channel surrounding the inner-air circuit, and a discharge region having exits configured to convey the main-feed fuel to another prefilming surface.

11. An airblast fuel nozzle assembly as set forth in claim 10, wherein the main-fuel-feed-circuit channel is situated radially outward from the pilot-fuel-feed-circuit channel.

12. An airblast fuel nozzle assembly as set forth in claim 10, wherein the main-fuel-feed-circuit channel is situated radially inward from the pilot-fuel-feed-circuit channel.

13. An airblast fuel nozzle assembly as set forth in claim 5, wherein the main-fuel-feed circuit, the pilot-fuel-feed circuit, the inner-air circuit and the outer-air circuit are arranged such that flows through the main-fuel-feed circuit and the pilot-fuel-feed circuit merge with flows through the inner-air circuit and the outer-air circuit upstream of the nozzle outlet.

14. An airblast fuel nozzle assembly as set forth in claim 1, wherein the sleeve structure comprises a series of coaxial sleeves, including a sleeve forming the central passageway of the inner-air circuit, and wherein the pilot-fuel-feed-circuit channel is formed between two of the sleeves.

15. An airblast fuel nozzle assembly as set in claim 14, wherein the main-fuel-feed circuit comprises a channel surrounding the inner-air circuit and wherein this channel is formed between two of the sleeves.

16. A gas turbine engine comprising a combustion chamber and the nozzle assembly set forth in claim 1 positioned to inject a fuel-air mixture into the combustion chamber, wherein fuel can be selectively supplied to one or both of the fuel-feed circuits.

17. A method of using the airblast fuel nozzle assembly as set forth in claim 1, said method comprising the steps of:

supplying fuel substantially only to the pilot-fuel-feed circuit during ignition stages of engine operation; and supplying fuel to only the main-fuel-feed circuit, or both the pilot-fuel-feed circuit and the main-fuel-feed circuit, during post-ignition stages of engine operation.

18. An airblast fuel nozzle assembly comprising a sleeve structure forming an inner-air circuit, an outer-air circuit, and a fuel-feed circuit;

the inner-air circuit including a central passageway through the sleeve structure extending to a nozzle outlet;

the outer-air circuit including an annular passageway radially surrounding the central passageway and extending to the nozzle outlet;

the fuel-feed circuit comprising a channel surrounding the inner-air-circuit central passageway, a prefilming surface surrounding the channel passageway upstream of the outer-air circuit, and a discharge region between the channel and the prefilming surface;

the discharge region comprising passages extending radially outward in the downstream direction and each passage having a downstream end configured to direct fuel from the channel against the prefilming surface.

19. An airblast fuel nozzle assembly as set forth in claim 18, wherein the fuel-feed circuit is a pilot-fuel-feed circuit, and wherein the sleeve structure forms another fuel-feed-circuit which is a main-fuel-feed circuit.

20. A gas turbine engine comprising a combustion chamber and the nozzle assembly set forth in claim 18 positioned to inject a fuel-air mixture into the combustion chamber.

* * * * *